United States Patent [19]

Scardenzan

[11] 4,040,639

[45] Aug. 9, 1977

[54] SKATEBOARD

[76] Inventor: Anthony Scardenzan, 269 N. Hillcrest Blvd., Inglewood, Calif. 90301

[21] Appl. No.: 670,361

[22] Filed: Mar. 25, 1976

[51] Int. Cl.[2] ..... A63C 17/14

[52] U.S. Cl. ..... 280/87.04 A; D34/15 AJ

[58] Field of Search ..... 280/87.04 A, 87.04 R, 280/87.01, 11.2, 11.22, 637; D34/15 AT, 15 AJ

[56] References Cited

U.S. PATENT DOCUMENTS

| | | | |
|---|---|---|---|
| 2,198,667 | 4/1940 | Haqenes | 280/87.04 A |
| 2,631,861 | 3/1953 | Daniska | 280/11.2 |
| 3,235,282 | 2/1966 | Bostick | 280/87.04 A |
| 3,288,251 | 11/1966 | Sakawa | 188/29 |
| 3,565,450 | 2/1971 | Rosenthal | 280/637 |
| 3,565,454 | 2/1971 | Stevenson | 280/87.04 A |
| 3,622,172 | 11/1971 | Goodwin | 280/11.22 X |
| 3,990,713 | 11/1976 | Hokanson | 280/11.2 X |
| D. 200,864 | 4/1965 | de Roco | 280/87.04 A |

*Primary Examiner*—Joseph F. Peters, Jr.
*Assistant Examiner*—John A. Pekar
*Attorney, Agent, or Firm*—Keith D. Beecher

[57] ABSTRACT

A skateboard is provided which is constructed to incorporate a braking device at its rear end for safety purposes; and which also includes in the embodiment to be described, a line tethered to the forward end which may be grasped by the operator, and a foot binding as additional safety features.

2 Claims, 6 Drawing Figures

SKATEBOARD

BACKGROUND OF THE INVENTION

The present day skateboard comprises an elongated platform mounted on rollerskate wheel truck assemblies at its forward and rear ends. The skateboard has become extremely popular in recent years. However, most prior art skateboards are inherently dangerous in that no adequate means is provided for stopping them in emergency conditions, or of preventing them from being propelled into pedestrians, or into the path of oncoming traffic, should the operator stumble and fall off of the platform.

Unlike the usual prior art skateboards, the skateboard of the present invention is constructed so that it may be easily and quickly braked by the operator by pivoting the platform upwardly about the axis of the rear truck assembly. In this way, the skateboard of the invention may be braked by a simple maneuver which in no way interferes with the normal operation of the board.

A flexible line is also provided in the embodiment to be described which is grasped by the operator, or which is clipped to the operator. The line may be contained in a spring biased reel, as will be described. With such a line, the skateboard is always under the control of the operator, and should the operator fall off of the board, he can stop the board from being propelled freely on its own and thereby prevent the creation of a hazard to vehicular traffic and pedestrians.

A foot binding is also provided in the embodiment to be described which securely holds one foot of the operator on the platform during normal operation of the skateboard, as an additional safety measure, but which permits the foot to be easily and quickly released.

DETAILED DESCRIPTION OF THE ILLUSTRATED EMBODIMENT

Figure 1:
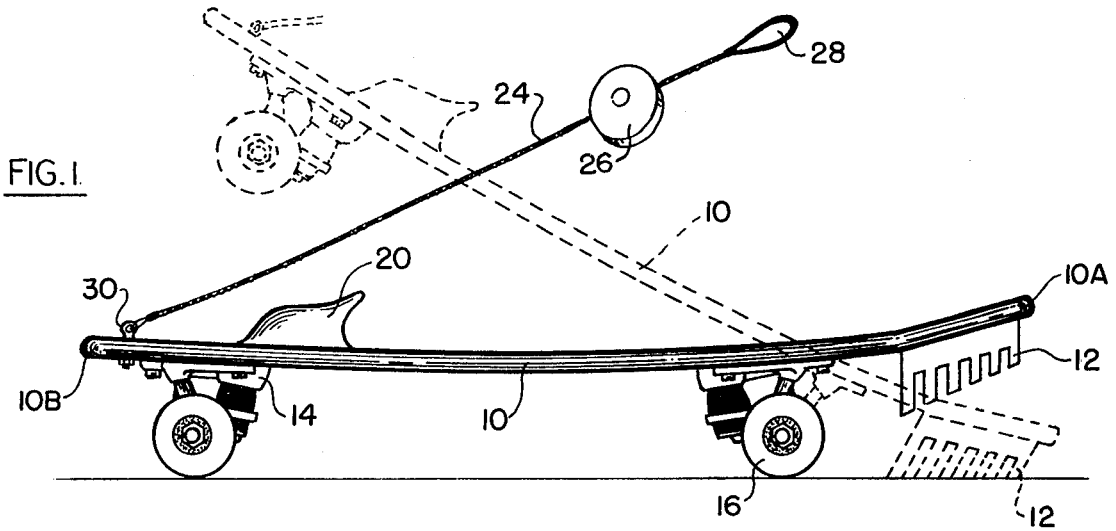
FIG. 1 is a side elevation showing a skateboard constructed in accordance with one embodiment of the invention.
Figure 2:
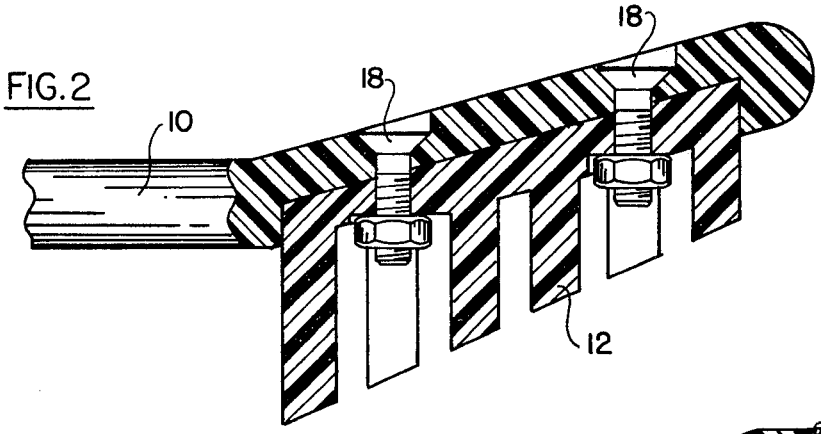
FIG. 2 is a detailed showing of a brake pad which is mounted at the rear end section of the skateboard.

The skateboard shown in the drawings includes an elongated platform 10 which may be tilted upwardly at its rear end section 10A, and which also includes a forward end section 10B. A braking pad 12 is mounted on the underside of the platform at the rear end section 10A. A first rollerskate wheel truck assembly 14 is mounted on the underside of the platform at the forward end section 10B, and a second rollerskate wheel truck assembly 16 is mounted to the underside of the platform at the rear end section thereof.

The skateboard shown in FIG. 1 may be braked, merely by tilting it about the pivot axis of the wheel truck assembly 16, as shown by the broken lines, so that the forward end section is moved upwardly, and the rear end section causes the brake pad 12 to engage the surface on which the skateboard is supported, in a frictional braking relationship. An advantage of this type of brake is that the operator automatically moves his body back to a stabilized position when the brake is applied and there is no tendency for the operator to be pitched forwardly over the front end of the skateboard.

Figure 3:
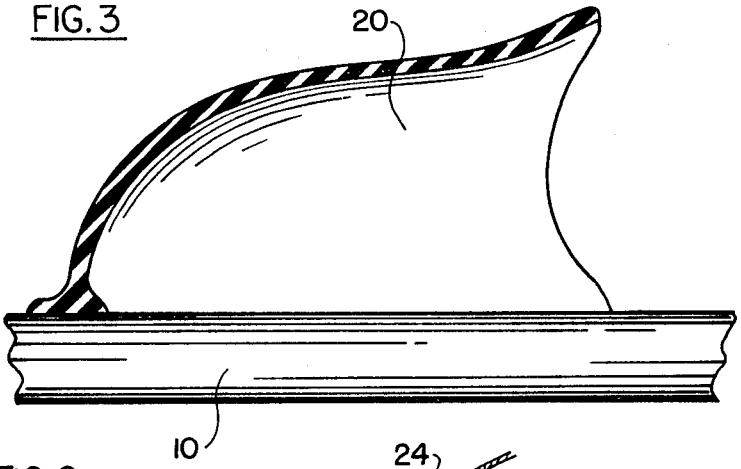
FIG. 3 is a detailed sectional representation of a foot binding which is mounted on the platform adjacent to the forward end section thereof.

The brake pad 12 is shown in more detail in FIG. 3, as illustrated, it may be formed of appropriate plastic material such as polyurethane. The pad 12 may be secured to the upwardly tilted rear end section 10A of the platform 10 by any appropriate means, such as for example, by means of bolts 18. The brake pad 12 may have any suitable shape to enable it smoothly to brake the skateboard when the board is tilted to apply the brake.

A foot binding 20 may be mounted on the top side of the platform adjacent to the forward end section thereof. The binding 20 may have the form shown in FIG. 3, and may be formed of a rubber-like, or other appropriate material. The foot of the operator is slipped into the binding through the open rear end thereof, to be firmly supported on the platform 10 by the binding. However, when so desired, the foot may be quickly and easily withdrawn from the binding through the open rear end. The binding 20 may be secured to the top side of platform 10 by an adhesive bonding material, or other appropriate means may be used for mounting the binding on the platform. The binding may be mounted on the platform in such a manner that it is adjustable along the platform to any desired position.

Figure 5:
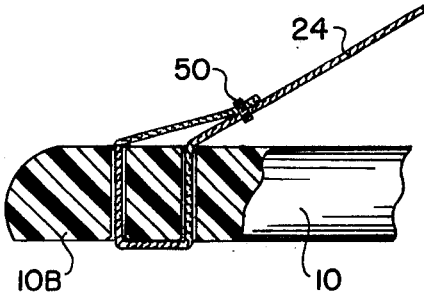
FIGS. 4–6 are detailed showings of the manners in which a handle may be tethered to the forward end section of the skateboard.
Figure 4:
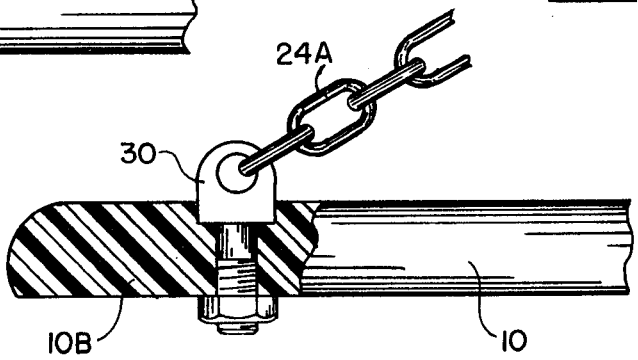

As also shown in FIG. 1, a flexible line 24 is tethered to the forward end section 10B of platform 10, which may, for example, be a chain, cable, leash, or the like. The line 24 is secured to the forward end section 10B of platform 10, as shown in FIG. 1, by means of a bolt 30, or other appropriate securing means, such as by a clip 50 in FIG. 5. The flexible line may be a chain 24A, as shown in FIG. 4.

Figure 6:
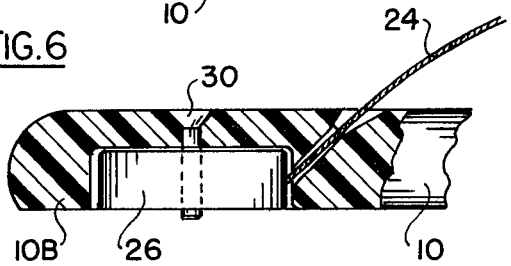

The line 24 may be contained in a spring-loaded reel 26, as shown in FIG. 1 which is clipped, for example, to the belt of the operator by a clip 28. Alternately, the reel 26 may be mounted under the forward end section 10B of the platform 10 by a screw 30, as shown in FIG. 6.

The invention provides, therefore, an improved skateboard which may be readily braked whenever desired, merely by pivoting the platform of the skateboard about the axis of the rear wheel truck assembly. The skateboard has additional safety features in the form of a foot binding which releasably supports the foot of the operator, and of a line which is tethered to the forward end section of the skateboard.

It will be appreciated that while a particular embodiment of the invention has been shown and described, modifications may be made. It is intended in the claims to cover the modifications which come within the spirit and scope of the invention.

What is claimed is:

1. A skateboard for carrying an operator in a standing position along a particular path on a supporting surface, the skateboard comprising: an elongated platform for supporting the operator and having a forward end section and an upwardly tilted rear end section; a first wheel truck assembly mounted to the underside of the platform at the forward end section, and a second wheel truck assembly mounted to the underside of the platform forward of the upwardly tilted rear end section; a braking pad secured to the underside of the platform under the upwardly tilted rear end section between the second wheel truck assembly and the rear extremity of the platform in position to engage the supporting surface in a braking relationship when the platform is tilted about the pivot axis of the second wheel truck assembly in a direction to raise the forward end section of the platform; a line tethered to the forward end section of the platform; a spring-loaded reel connected to the line for receiving the line; clip means attached to the line for attaching the line to the operator of the skateboard; and a foot binding mounted on the top side of the platform adjacent to the forward end section thereof and having an open rear end for releasably receiving one foot of the operator on the platform.

2. The skateboard defined in claim 1, in which the braking pad is formed of a plastic material.

* * * * *